US005899599A

United States Patent [19]

Kato

[11] Patent Number: 5,899,599

[45] Date of Patent: May 4, 1999

[54] FIXING DEVICE AND FIXING METHOD

[75] Inventor: Takeshi Kato, Itami, Japan

[73] Assignee: Minolta Co., Ltd., Osaka, Japan

[21] Appl. No.: 08/921,124

[22] Filed: Aug. 29, 1997

[30] Foreign Application Priority Data

Sep. 3, 1996 [JP] Japan ..... 8-233348

[51] Int. Cl.[6] ..... G03G 15/20

[52] U.S. Cl. ..... 399/69; 399/70; 430/124

[58] Field of Search ..... 399/69, 67, 70, 399/328, 330; 219/216, 469, 470, 492, 494; 347/156; 430/124

[56] References Cited

U.S. PATENT DOCUMENTS

| | | | |
|---|---|---|---|
| 4,737,818 | 4/1988 | Tanaka et al. | 399/70 |
| 4,888,464 | 12/1989 | Shibata et al. | 219/216 |
| 4,996,567 | 2/1991 | Watarai et al. | 399/70 |
| 5,280,328 | 1/1994 | Goto et al. | 399/70 |
| 5,530,556 | 6/1996 | Miura et al. | 347/156 X |
| 5,636,012 | 6/1997 | Uneme et al. | 399/325 |
| 5,671,462 | 9/1997 | Toyohara et al. | 399/330 |
| 5,695,902 | 12/1997 | Mikuriya et al. | 430/126 |
| 5,701,556 | 12/1997 | Sugimoto | 399/70 |
| 5,708,949 | 1/1998 | Kasahara et al. | 399/330 |

FOREIGN PATENT DOCUMENTS

| | | |
|---|---|---|
| 59-072464 | 4/1984 | Japan . |
| 59-189381 | 10/1984 | Japan . |
| 61-45831 | 10/1986 | Japan . |

*Primary Examiner*—Arthur T. Grimley
*Assistant Examiner*—Sophia S. Chen
*Attorney, Agent, or Firm*—McDermott, Will & Emery

[57] ABSTRACT

A fixing device capable of producing fixed images of excellent quality by using a thin-layer rotating heating member and a heating element capable of rapidly and directly heating a rotating heating member to shorten the warm-up time of the rotating heating member, and capable of suppressing fluctuation of the rotating heating member temperature when a recording member is inserted between the rotating heating member and a rotating pressure member after the rotating heating member has been warmed up. The fixing device has a heating roller heated by a resistance heating element, a pressure roller opposite the heating roller, a temperature detector to detect the heating roller temperature, and a control unit to control the power supplied to the resistance heating element based on the temperature detected by the temperature detector. The heating roller and the pressure roller start rotating before the warm-up period ends, and power is supplied to the resistance heating element at a power level required to maintain the temperature of the heating roller at a predetermined fixing temperature directly after insertion of a recording member, bearing an unfixed image, between the heating roller and the pressure roller in accordance with the rate of temperature rise of the heating roller, during rotation of the heating roller, from the start of rotation or after the start of rotation of the hearing roller, but before the warm-up period ends.

23 Claims, 8 Drawing Sheets

FIXING DEVICE AND FIXING METHOD

BACKGROUND OF THE INVENTION

1. Field of the Invention

The present invention relates to a fixing device to heat and fix an unfixed image such as a toner image carried on a recording member in an image forming apparatus such as electrophotographic copiers, printers, facsimiles and the like.

2. Description of the Related Art

Fixing devices used in image forming apparatuses such as copiers, printers, facsimiles and the like which form print images by electrophotographic methods generally are provided with a rotating heating member such as a heating roller, heating belt or the like to heat and fix an unfixed image on a recording member, and a recording member bearing an unfixed image such as a toner image is passed between a heating member and a rotating pressure member such as pressure roller or pressure belt arranged opposite said heating member, so as to accomplish heat-fixing of the unfixed image under pressure.

Heretofore, rotating heating members heated by radiant heat from a heater such as a halogen lamp heater have been used frequently. In fixing devices using rotating heating members which utilize halogen lamp heaters or the like as a heat source, however, the speed of the temperature rise is quite slow from the time current starts flowing to said heater until the surface of the rotating heating member attains a predetermined constant temperature, thereby making the apparatus difficult to use due to the lengthy preheating time (i.e., the so-called warm-up time) required from the moment the image forming apparatus main power source is turned ON until the rotating heating member attains a predetermined constant temperature. In order to slightly alleviate this disadvantage, fixing devices have been realized which have thinner and smaller diameter rotating heating members, and so require less heat capacity.

An example of reducing the warm-up time by adding a smaller heat capacity by using a thin-layer rotating heating member is disclosed in Japanese Laid-Open Patent Application No. 59-189381, which proposes using a heating roller formed so as to rotate a resistance heating member, which comprises a material that generates heat via a current flow, in conjunction with a core roller, and using an electromagnetic induction heating means including an induction coil arranged in close proximity to a rotating heating member.

Although the thin-layer rotating heating member can be heated rapidly, the surface temperature of such rotating heating member fluctuates greatly due to the small heat capacity even with slight heat transfer from the rotating heating member to other elements, unlike thick-layer rotating heating members. Naturally, this tendency becomes greater as the rotating heating member becomes thinner.

This condition results in a rapid drop in the temperature of the rotating heating member as the rotating heating member is rotated after warm-up when heat is lost to the rotating pressure member which is rotated in contact with said rotating heating member, and when heat is lost to a recording member directly after said recording member is inserted between the rotating heating member and the rotating pressure member.

Inadequate fixing and fixing of irregular strength results when an unfixed image is fused to a recording member with the temperature of the rotating heating member in the aforesaid reduced state.

Of course, although the temperature of the rotating heating member is normally controlled at a predetermined temperature via feedback control by detecting the surface temperature of the rotating heating member using a temperature detecting means, the temperature detecting means (typically a thermistor) used in such temperature control has poor responsiveness and results in temperature dispersion until the temperature detecting means responds. The influence of temperature dispersion is particularly excessive in regulating a constant temperature when accomplishing fixing under heat and pressure using a rotating heating member having a small heat capacity, and makes it difficult to maintain the surface temperature of the rotating heating member at a constant temperature.

Although the temperature dispersion of the rotating heating member is minimized if printing starts after the rotating heating member temperature is adjusted as the rotating heating member is rotated so as to allow adequate heating of the rotating pressure member and peripheral elements, this arrangement controverts the object of shortening the warm-up time by reducing the heat capacity of the rotating heating member, such that when the heat capacity of the rotating heating member is reduced, a temperature drop cannot be avoided when a recording member is inserted even when, for example, printing starts after the rotating pressure roller and peripheral elements have been adequately heated.

In this regard, Japanese Patent No. 61-45831 discloses on Lines 14 through 22 of column 3, Page 2, "The embodiments of the present invention provide that, in the fixing device of FIG. 1, a heating member 4 is forcibly turned ON directly after a slow warm-up of the sensitivity of a temperature detector 3, to forcibly heat a fixing roller 1 until the temperature of the peripheral elements is elevated and the sensitivity of said temperature detector 3 attains a suitable level." In the case of fixing devices using a heating roller having a built-in heater, the image forming apparatus using said fixing device initially turns ON a heater until the heating roller attains a predetermined temperature, and said heater is forcibly turned ON when the heating roller starts to rotate and the fixing device starts operation after the warm-up ends so as to prevent a temperature drop of the heating roller during the initial period of use of the fixing device, and thereby avoid concomitant inadequate fixing.

It is not desirable, however, to have the heater always turned ON by at same power level when forcibly turning ON the heater after warm-up ends. The situations are completely different when again warming up directly after printing several sheets, and when starting warm-up with the pressure roller pressed against the heating roller and the elements peripheral to the fixing device all in low temperature states as when the image forming apparatus has not been used for an extended period.

That is, when the pressure roller and peripheral elements of the fixing device are warm before the start of the heating roller warm-up, as when reheating the heating roller directly after printing several pages, there is only slight heat transfer from the heating roller to the other elements when the heater is forcibly turned ON after the aforesaid warm-up and the heating roller attains an excessively high temperature, thereby causing the unfixed toner to become too molten and transfer onto the heating roller with the likely possibility of causing so-called high-temperature offset. The problem of high-temperature offset becomes more pronounced as the heating roller becomes thinner and the heat capacity becomes smaller.

The present invention provides a fixing device comprising a rotating heating member heated by a heating means, a rotating pressure member which presses against said rotating heating means, a temperature detecting means to detect the temperature of said rotating heating means, and a control means to control the electric power supplied to said heating means based on the temperature detected by said temperature detecting means, said fixing device being of a type which fixes an unfixed toner image on a recording member by having a recording member bearing an unfixed toner image pass between said rotating heating member and said rotating pressure member, and wherein the warm-up time of said rotating heating member can be shortened by using a thin-layer rotating heating member and a heating means capable of rapidly and directly heating said rotating heating means, and wherein temperature fluctuation of the rotating heating member is controlled when a recording member is inserted between said rotating heating member and said rotating pressure member after the rotating heating member has been warmed up so as to produce fixed images of excellent quality. And the present invention provides A heating method comprising steps of warming-up a rotating member, rotating said rotating member before end of said warming-up step, detecting the temperature of said rotating member, and controlling the temperature of said rotating member to maintain a predetermined temperature after said warming-up step, in accordance with the rate of temperature rise during rotating operation of said rotating step.

SUMMARY OF THE INVENTION

The fixing device of the present invention eliminates the previously described disadvantages based on the knowledge described below.

The heated state of the fixing device can be roughly known by detecting the temperature of the rotating pressure member pressed against the rotating heating member. When cold, the greatest loss of heat of a rotating heating member heated by a heating means is through contact with the rotating pressure member. When the rotating pressure member is preheated, an inserted recording member can be heated from the back so as to readily control the temperature of the rotating heating member by a low electric power and provide excellent fixing. From these facts it is known that fixed images of excellent quality can be obtained and wasteful power consumption prevented if a rotating heating member is rotated while warming up and the rotating pressure roller is rotated in conjunction therewith so as to achieve thorough heat transfer from the rotating heating member to the rotating pressure member beforehand, and the heated state of the rotating pressure member is intermittently detected from the rate of temperature rise of the rotating heating member, i.e., the overall heated state of the fixing device is detected, so as to supply to the heating means the electrical power required to maintain the rotating heating member at a predetermined temperature when a recording member is inserted between the rotating heating member and the rotating pressure member.

In order to eliminate the previously described disadvantages based on the aforesaid knowledge, the present invention provides a fixing device to fuse an unfixed image on a recording member bearing said unfixed image, said fixing device comprising, a rotating heating member heated by a heating means, a rotating pressure member pressed against said rotating heating means, a temperature detecting means to detect the temperature of said rotating heating means, and a control means to control the electric power supplied to said heating means based on the temperature detected by said temperature detecting means, and wherein said rotating heating member starts rotation before warm-up of said heating member ends, and wherein said control means controls the electric power so as to supply to said heating means the electric power required to maintain the temperature of said rotating heating member at a predetermined temperature directly after insertion of a recording member between said rotating heating member and said rotating pressure member in accordance with the rate of temperature rise of said rotating heating member when said rotating heating member starts rotation or during rotating of said rotating heating member before the warm-up period ends after the start of rotation.

Specific examples of this fixing device follow below.

(1) A fixing device wherein said control means is capable of controlling the electric power so as to supply to said heating means the power required to maintain the temperature of the rotating heating member at a predetermined temperature directly after a recording member is inserted between said rotating heating member and said rotating pressure member in accordance with the temperature rise time from a first temperature detected by said temperature detecting means when said rotating heating member starts rotation or after the start of said rotation until attainment of a second temperature detected during rotation of said rotating heating member before the warm-up ends after the detection of said first temperature.

(2) A fixing device wherein said control means is capable of controlling the electric power so as to supply to said heating means the power required to maintain the temperature of the rotating heating member at a predetermined temperature directly after a recording member is inserted between said rotating heating member and said rotating pressure member in accordance with the difference between a first temperature detected by said temperature detecting means when said rotating heating member starts rotation or after the start of said rotation and a second temperature detected during rotation of said rotating heating member before the warm-up ends and after a predetermined time has elapsed since the detection of said first temperature.

Methods for varying the electric power applied to a heating means include varying the electric power by pulse width control, phase control or the like when said heating means is a resistance heating element heated by a current flow, and varying the electric power by frequency control when using a high frequency electromagnetic induction heating means. Furthermore, when the heating means has two or more heat sources, the electric power supplied to the heating means can be varied by supplying a common power selectively to a specific heating source among said two or more heating sources when the aforesaid control means controls the power supplied to said heating means. The heating source may be, for example, a heating lamp, and when using a plurality of said heating lamps, use of heating lamps having different power consumption, i.e., different heat release values, may be considered.

The rotating pressure member may be driven in rotation via the friction force produced through contact with the rotating heating member when said rotating heating member is powered in rotation, or may be driven in rotation by the friction force produced by a recording member passing medially to said rotating heating member and said rotating pressure member, or may itself be powered in rotation.

The fixing device of the present invention may be installed in image forming apparatuses which form print images by electrophotographic methods such as copiers, printers, facsimile machines and the like or combinations thereof, which fix an unfixed image on a recording member by passing said recording member bearing an unfixed image between said rotating heating member and said rotating pressure member.

According to this fixing device, the aforesaid rotating heating member starts rotation before the rotating heating member warm-up period ends (e.g., simultaneously with the warm up, or after the start of the warm-up but before the end of the warm-up), to achieve thorough heating of the rotating heating member during the warm-up. Furthermore, when a recording member bearing an unfixed image is inserted between the rotating heating member and the rotating pressure member, the power required to maintain the heating member at a predetermined temperature directly after said insertion is supplied to the heating means of the rotating heating member in accordance with the rate of temperature rise (i.e., the rate of temperature rise of the rotating heating member, or again, the rate of temperature rise of the overall fixing apparatus) of the rotating heating member at the start of rotation of the rotating heating member or during rotation of said rotating heating member after the start of said rotation but before the warm-up ends. Since this supplied power thoroughly preheats the rotating heating member to a certain degree, a low power is sufficient to readily control the temperature of the rotating heating means to a predetermined temperature.

Therefore, when using a construction to shorten the warm-up time of a rotating heating member by using a thin-layer rotating heating member and a heating means capable of rapidly and directly heating said rotating heating member, fixed images of excellent quality can be obtained by controlling the fluctuation of the temperature of the rotating heating member when a recording member is inserted between the rotating heating member and the rotating pressure member after a rapid warm-up of the rotating heating member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

The preferred embodiments of the present invention are described hereinafter with reference to the accompanying drawings.

Figure 1A:
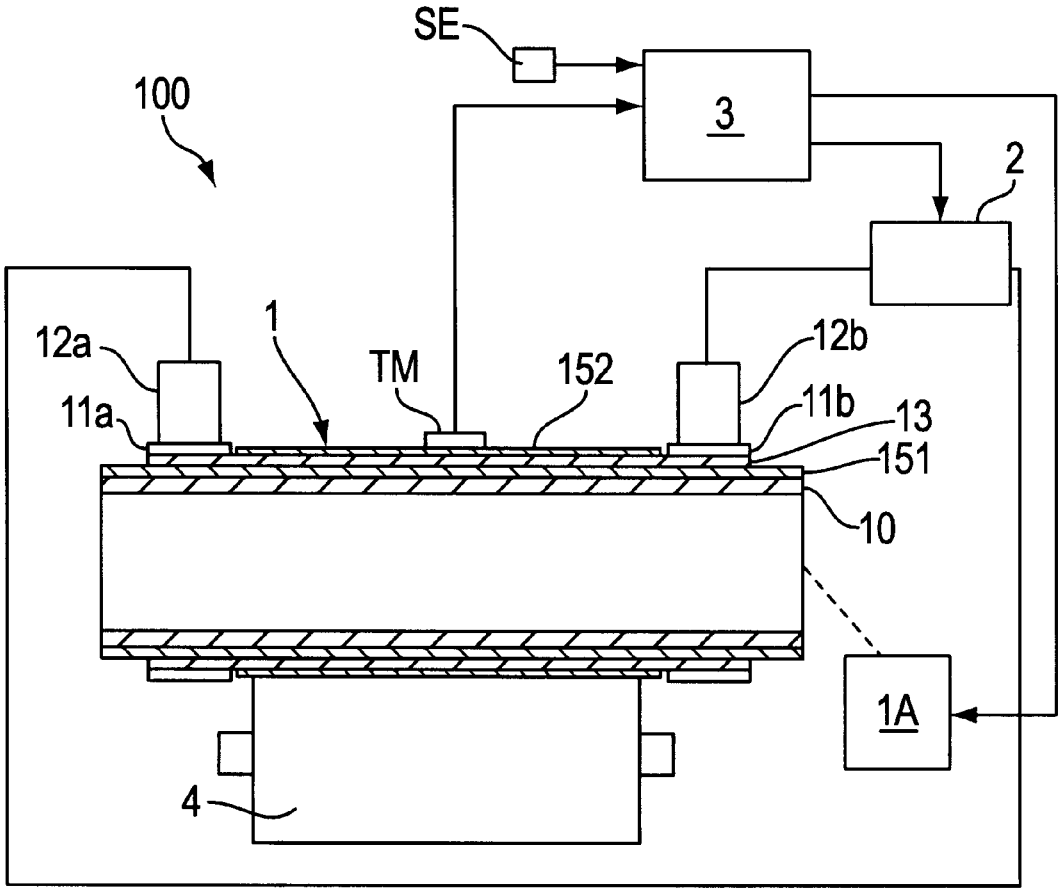
FIG. 1A is a brief section view of an example of the fixing device of the present invention.
Figure 1B:
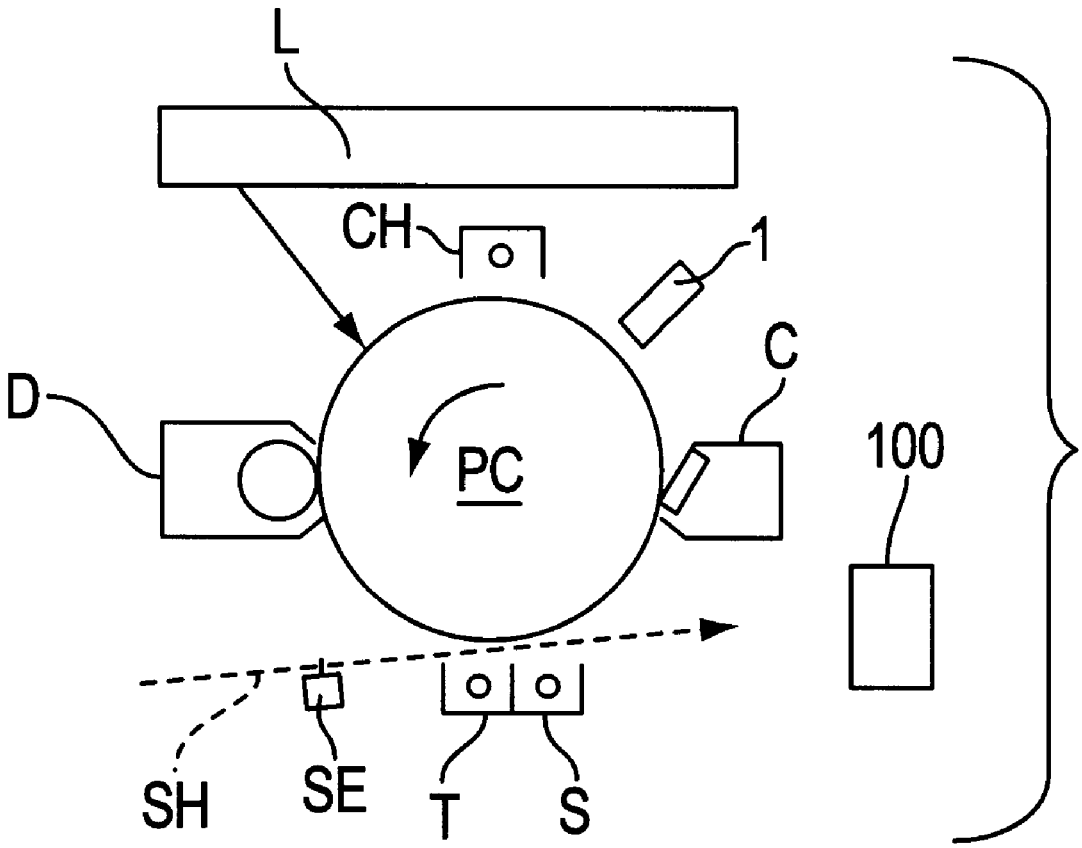
FIG. 1B briefly shows the construction of an example of a copying machine incorporating the fixing device of FIG. 1A.

FIG. 1A is a brief section view of an example of the fixing device of the present invention, and FIG. 1B briefly shows the construction of a copying machine of the electrophotographic type which incorporates the fixing device of FIG. 1A.

The copying machine of FIG. 1B is centrally provided with a photosensitive drum PC, around the periphery of which are sequentially arranged a charger CH, developing device D, transfer charger T, separation charger S, cleaner C, and eraser I. An optical scanning unit L is provided above photosensitive drum PC optically scan a document image, and a fixing device 100 of the present invention is disposed on the downstream side of separation charger S.

According to this copying machine, the photosensitive drum PC is powered in rotation in a counterclockwise direction in the drawing by a drive means not shown in the illustration, the surface of the drum is uniformly charged by charger CH, and an image is exposed on the charged region by scanning of a document image by optical unit L, so as to form an electrostatic latent image on the surface of photosensitive drum PC. This electrostatic latent image is developed as a toner image by developing device D, and the toner image is transferred via transfer charger T onto a recording member SH fed from a recording member (typically a recording sheet) supply unit not shown in the illustration. This recording member SH is then separated from the photosensitive drum PC by separation charger S and transported to fixing device 100 to fuse the unfixed toner image onto the recording member SH, which is subsequently ejected from the copier. The residual toner remaining on the surface of the photosensitive drum PC is removed by cleaner C, and the residual charge remaining on the surface of photosensitive drum PC is removed by eraser I.

The fixing device 100 is provided with a heating roller 1, and a pressure roller 4 which is pressed against said heating roller 1 by a pressing means not shown in the drawings. The heating roller 1 and pressure roller 4 are respectively supported by support means (not illustrated) so as to be rotatable. Heating roller 1 can be powered in rotation in the direction of recording sheet transport by a drive device 1A that includes a motor. Pressure roller 4 is driven in rotation via the friction force produced through contact with the heating roller when said heating roller is rotated, and is driven in rotation by a friction force produced by a recording member when said recording member passes between the eating roller 1 and the pressure roller 4.

The aforesaid heating roller 1 comprises a cylindrical aluminum core roller 10 formed as a thin layer having a thickness to a degree which does not pose a problem respective to strength, and sequentially superimposed over the exterior surface of said core roller 10 are an electric insulation layer 151, layer-like resistance heating element 13, and separation layer 152.

The electric insulation layer 151 is a polyimide heat-resistant insulation resin formed on the entire exterior surface of the core roller 10.

The separation layer 152 is formed of polytetrafluoroethylene (PTFE), and is provided to allow easy separation of a heated toner image from the heating roller 1 when a recording member passes between the heating roller 1 and the pressure roller 4 pressing against said heating roller 1, and has a width equal to or greater than the maximum width of said recording member.

Resistance heating element 13 is formed so as to have a width somewhat narrower than the electric insulation layer 151, and a width greater than separation layer 152 so as to accommodate the insertion of power receiving elements 11*a* and 11*b* (described later). This resistance heating element 13 is formed of barium titanate ceramic material which itself releases joule heat via an applied electric current.

Electric insulation layer 151, resistance heating element 13, and separation layer 152 rotate integratedly with the core roller 10.

A pair of electrically conductive copper alloy ring-like power receiving elements 11*a* and 11*b* are provided at the bilateral exterior end surfaces of resistance heating element 13 which extend from the separation layer 152 as previously mentioned, and are fixedly attached to said resistance heating element 13. The power receiving elements 11*a* and 11*b* also rotate integratedly with the core roller 10.

A pair of electrically conductive, carbon power supplying elements 12*a* and 12*b* are respectively arranged in contact with the exterior surface of power receiving elements 11*a* and 11*b*. Each power supplying element 12*a* and 12*b* is elastically pressed toward power receiving elements 11*a* and 11*b* via a spring means (not illustrated), so as to maintain the electrical connection of the contact surfaces even when power receiving elements 11*a* and 11*b* rotate integratedly with the core roller 10.

A thermistor TM is arranged so as to be in contact with the surface of the separation layer 152 of heating roller 1 to detect the temperature of said heating roller 1.

The power supplying element 12*a* is connected to one end of a power source 2, and power supplying element 12*b* is connected to the other end of power source 2 so that electric power is supplied from said power source 2 to resistance heating element 13. Power source 2 includes an alternating current (AC) power source so as to allow the supplied power to be varied by pulse width modulation.

The electric power supplied from power source 2 to resistance heating element 13 is controlled by commands from control unit 3 which controls the general operation of the copying machine incorporating this fixing device.

Heating roller 1 is rotated based on commands from control unit 3 to the rotation drive device 1A of heating roller 1.

The temperature information detected by thermistor TM is transmitted to control unit 3.

Control unit 3 mainly comprises a microcomputer but is not limited to a microcomputer, and operates the copying machine to form copy images. When the power source of the copier is turned ON, control unit 3 issues instructions to power source 2 of fixing device 100 to start supplying power to resistance heating element 13 to begin warming up said fixing device 100. In one embodiment, control unit 3 issues instructions to rotation drive device 1A to start rotation of heating roller 1 simultaneously with the start of the warm-up period, whereas in another embodiment said rotation starts after the start of said warm-up but before the end of said warm-up, and further starts the driven rotation of pressure roller 4 in conjunction with the rotation of heating roller 1.

That is, in this fixing device, warming up is accomplished while both roller 1 and 4 are rotating.

Control unit 3 determines the power to be supplied to resistance heating element 13 and controls the power source 2 so as to supply said power to the resistance heating element 13 to regulate the heating roller temperature to a predetermined temperature by supplementing the heat lost to a recording member directly after a recording member bearing an unfixed image is inserted between the heating roller 1 and the pressure roller 4 in accordance with the rate of temperature rise of said heating roller 1 based on the temperature information received from thermistor TM during rotation of heating roller 1 after the start of said rotation by heating roller 1 (although temperature detection may be accomplished from the start of rotation by the heating roller, said detection occurs after said rotation has started in the present embodiment) but before the warm-up period ends. Thereafter, the control unit 3 regulates the temperature of heating roller 1 to a predetermined fixing temperature (i.e., constant-temperature regulation) based on the temperature detected by thermistor TM as necessary.

The rate of temperature rise of heating roller 1 during rotation of said heating roller after the start of rotation by said roller but before the end of the warm-up period is determined as described below.

(1) The temperature rise time is determined from a first temperature detected by thermistor TM after the start of rotation by heating roller 1 until a second temperature detected after the detection of said first temperature and before the end of the warm-up period, and the rate of temperature rise is determined from the time between said two temperatures and the temperature elevation.

(2) The difference is determined between a first temperature detected by thermistor TM after the start of rotation by heating roller 1 and a second temperature detected after the elapse of a predetermined time interval from the detection of said first temperature and before the end of the warm-up period, and the rate of temperature rise is determined from said predetermined time interval and the temperature difference.

Figure 2:
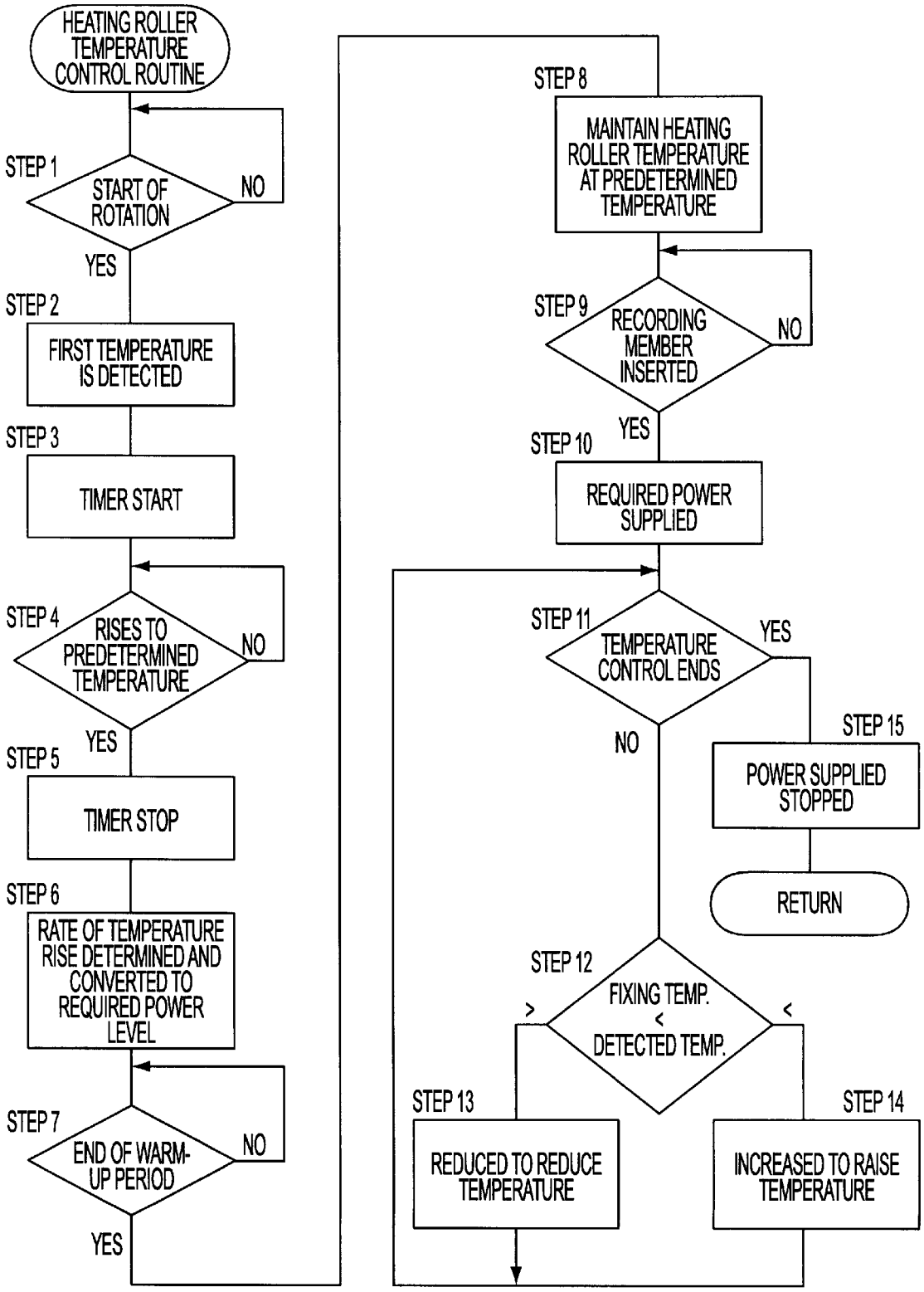
FIG. 2 is a flow chart showing an example of control of the temperature of a heating roller, i.e., control of the current supplied to a resistance heating element, via a control unit.
Figure 3:
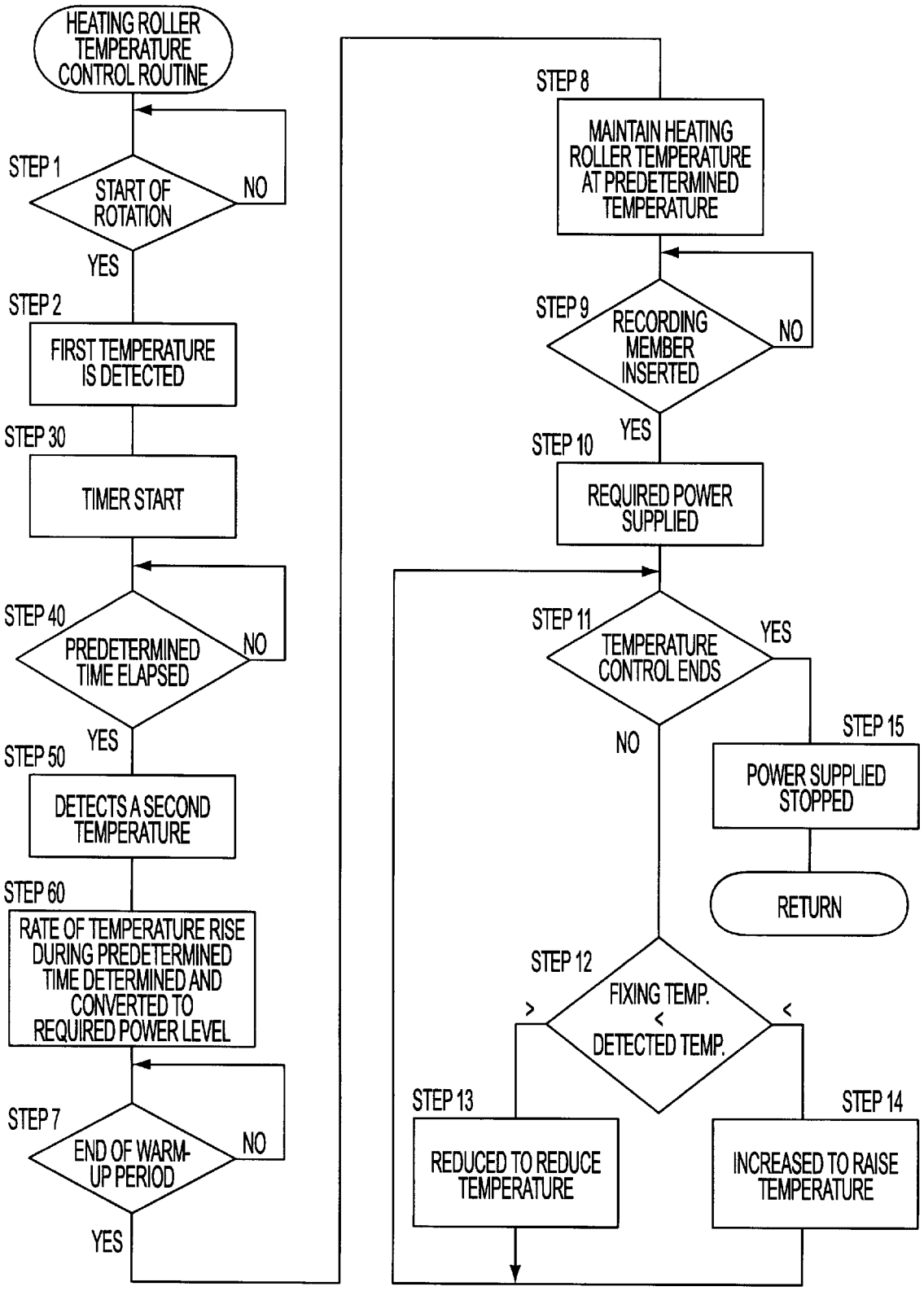
FIG. 3 is a flow chart showing another example of control of the temperature of a heating roller, i.e., control of the current supplied to a resistance heating element, via a control unit.

FIG. 2 is a flow chart showing the control of the temperature of heating roller, i.e., control of the current supplied to resistance heating element 13, via a control unit when the rate of temperature rise is determined by method (1) above. FIG. 3 is a flow chart showing the control of the temperature of heating roller, i.e., control of the current supplied to resistance heating element 13, via a control unit when the rate of temperature rise is determined by method (2) above.

Figure 4:
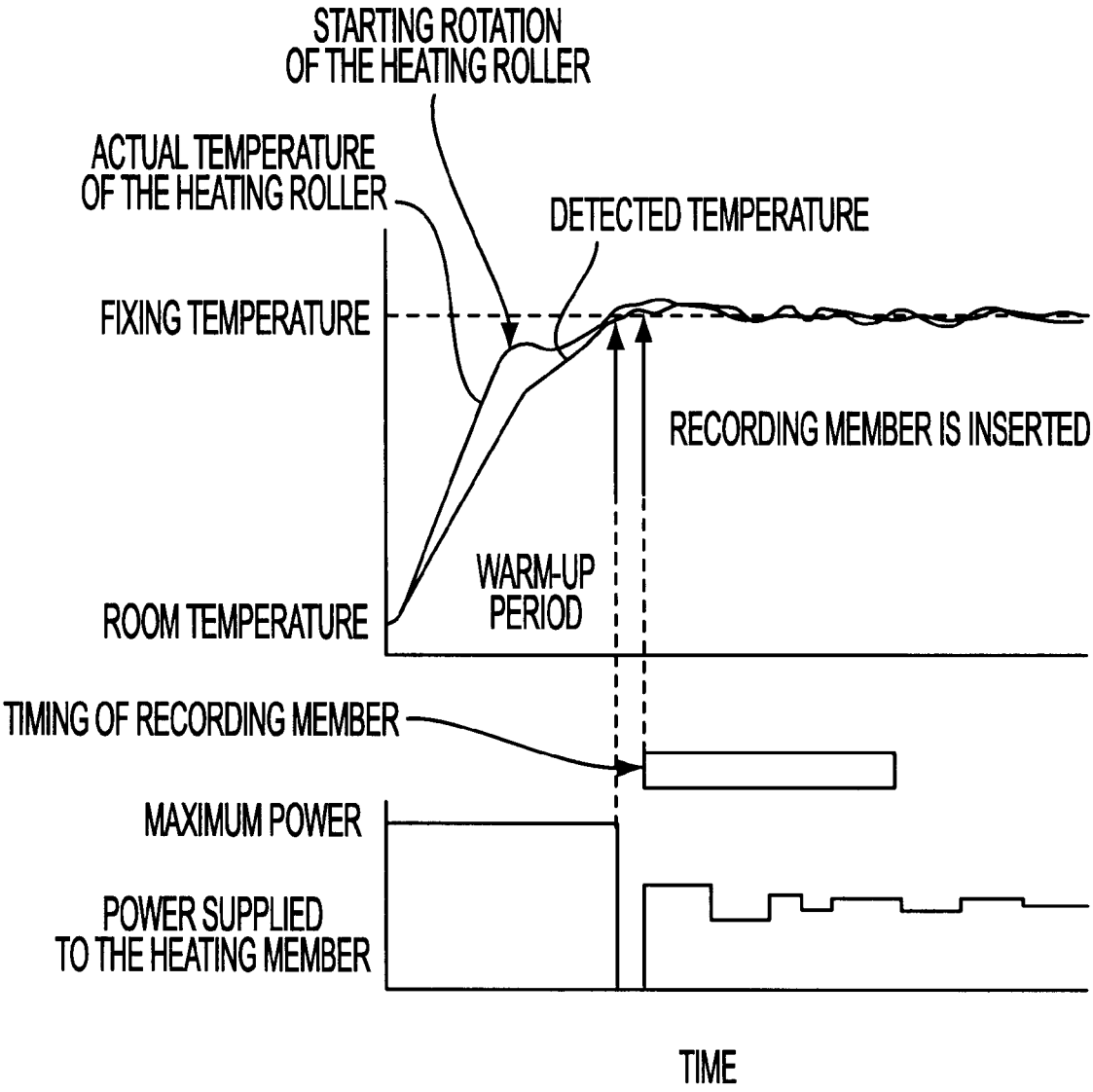
FIG. 4 illustrates an example the surface temperature of a heating roller and the change in the temperature detected by a thermistor when the heating roller starts rotation after the start of the warm-up period, and an example of the control of power supplied to a resistance heating element, and an example of the timing of passing a recording sheet between heating and pressure rollers (sheet transport timing)

FIG. 4 shows an example the surface temperature of heating roller 1 and the change in the temperature detected by thermistor TM after the start of the warm-up period, and an example of the change in power supplied to a resistance heating element, and an example of the timing of passing a recording sheet between heating and pressure rollers.

Figure 5:
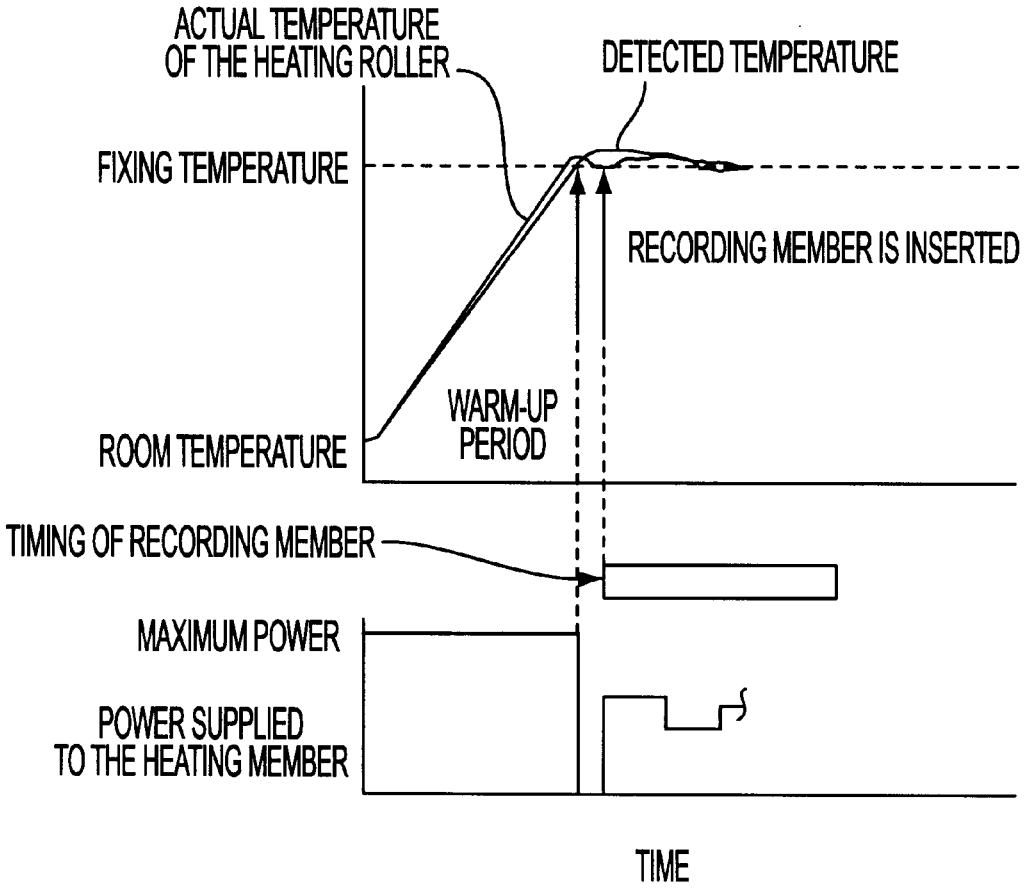
FIG. 5 shows an example the surface temperature of a heating roller and the change in the temperature detected by a thermistor when the heating roller starts rotation simultaneously with the start of the warm-up period, and an example of the control of power supplied to a resistance heating element, and an example of the timing of passing a recording sheet between heating and pressure rollers (sheet transport timing)

FIG. 5 shows an example the surface temperature of heating roller 1 and the change in the temperature detected by thermistor TM when the heating roller starts rotation simultaneously with the start of the warm-up period, and an example of the change in power supplied to resistance heating element 13, and an example of the timing of passing a recording sheet between heating and pressure rollers.

When a power source is turned ON for the copier incorporating the aforesaid fixing device 100, a constant maximum power is continuously supplied from power source 2 to resistance heating element 13 based on instructions from control unit 3 to start warming up the fixing device. Furthermore, heating roller 1 starts rotation simultaneously with the start of the warm up or after the start of the warm up, and the driven rotation of pressure roller 4 starts via the rotation of heating roller 1 (refer to FIGS. 4 and 5).

In one embodiment, FIG. 2 shows the heating roller temperature control routine in the operation main routine executed by control unit 3 and omitted from the drawing of the main routine. In this example, a first temperature is detected by thermistor TM after the start of rotation of heating roller 1 (Steps 1 and 2), and thereafter the control unit 3 internal timer is started (Step 3), thermistor TM continuously detects the temperature and when said detected temperature attains a predetermined second temperature (i.e., when the temperature rises to a predetermined temperature), the aforesaid timer is stopped (Steps 4 and 5), and the rate of temperature rise is determined from the time required from said first temperature to attain said second temperature. This rate of temperature rise is converted to a required power level (estimated required power) to be supplied to the resistance heating member to maintain a heating roller temperature at a predetermined temperature needed to achieve image fixing (i.e., fixing temperature) directly after a recording member bearing an unfixed toner image is inserted between said heating roller 1 and pressure roller 4 (Step 6). Constant-temperature regulation mode is entered to maintain the heating roller temperature at a predetermined temperature for fixing while the end of the warm-up period is awaited (Steps 7 and 8), and aforesaid estimated required power begins to be supplied to resistance heating element 13 by the timing of the recording member inserted between the heating roller 1 and pressure roller 4 (Steps 9 and 10). The timing of the insertion of the recording member between rollers 1 and 4 is determined by control unit 3 based on the signal from a sensor capable of detecting the passage of a recording sheet and disposed upstream from fixing device 100 within the recording member transport path (indicated by the dashed line in FIG. 1B), i.e., a detection signal of paper feed sensor SE provided upstream from the transfer region in the present embodiment. Thereafter, the temperature detected by thermistor TM is compared to a predetermined temperature required for fixing (i.e., fixing temperature). When the detected temperature is greater than the predetermined temperature, the power supplied to resistance heating element 13 is reduced to reduce the temperature of heating roller 1, whereas when the detected temperature is less than the predetermined temperature, the power supplied to resistance heating element 13 is increased to raise the temperature of heating roller 1 (Steps 11 through 14). When the heating roller temperature control ends, the power supplied to resistance heating element 13 is stopped, and the routine returns to the main routine (Steps 11 and 15).

In another embodiment, FIG. 3 shows the heating roller temperature control routine in the operation main routine executed by control unit 3 and omitted from the drawing of the main routine. The control routine shown in FIG. 3 replaces Steps 3 through 6 in the routine of FIG. 2 with Steps 30 through 60, but is otherwise identical with the routine of FIG. 2.

In this example, after a first temperature is detected by thermistor TM after the start of rotation of heating roller 1 (Steps 1 and 2), the control unit internal timer is started (Step 30), and thermistor TM detects a second temperature after a predetermined time interval has elapsed (Steps 40 and 50), and the rate of temperature rise during said predetermined time interval is determined from the difference between said first and second detected temperatures. This rate of temperature rise is converted to a required power to be supplied to the resistance heating member to maintain the heating roller temperature at a predetermined temperature needed to achieve image fixing directly after a recording member bearing an unfixed toner image is inserted between said heating roller 1 and pressure roller 4 (Step 60); thereafter, the power supply control is identical to the routine of FIG. 2.

In the previously described fixing device 100, the power supplied to resistance heating element 13 after a recording member is inserted between heating roller 1 and pressure roller 4 is an adequate low power which is less than the maximum constant power supplied during the warm-up period, as shown in FIGS. 4 and 5. The adequacy of this low power is due to the thorough heating of the pressure roller 4 via the rotation drive by heating roller 1 during the warm-up period, and the calculation of the estimated required power during insertion of a recording member which is estimated from the rate of temperature rise of the heating roller during the warm-up period, thereby provided a power level that is neither excessive nor inadequate. As shown in FIGS. 4 and 5, the actual temperature of the heating roller 1 is precisely and stably regulated at the fixing temperature regardless of whether or not a recording member is inserted between the aforesaid rollers.

Figure 6:
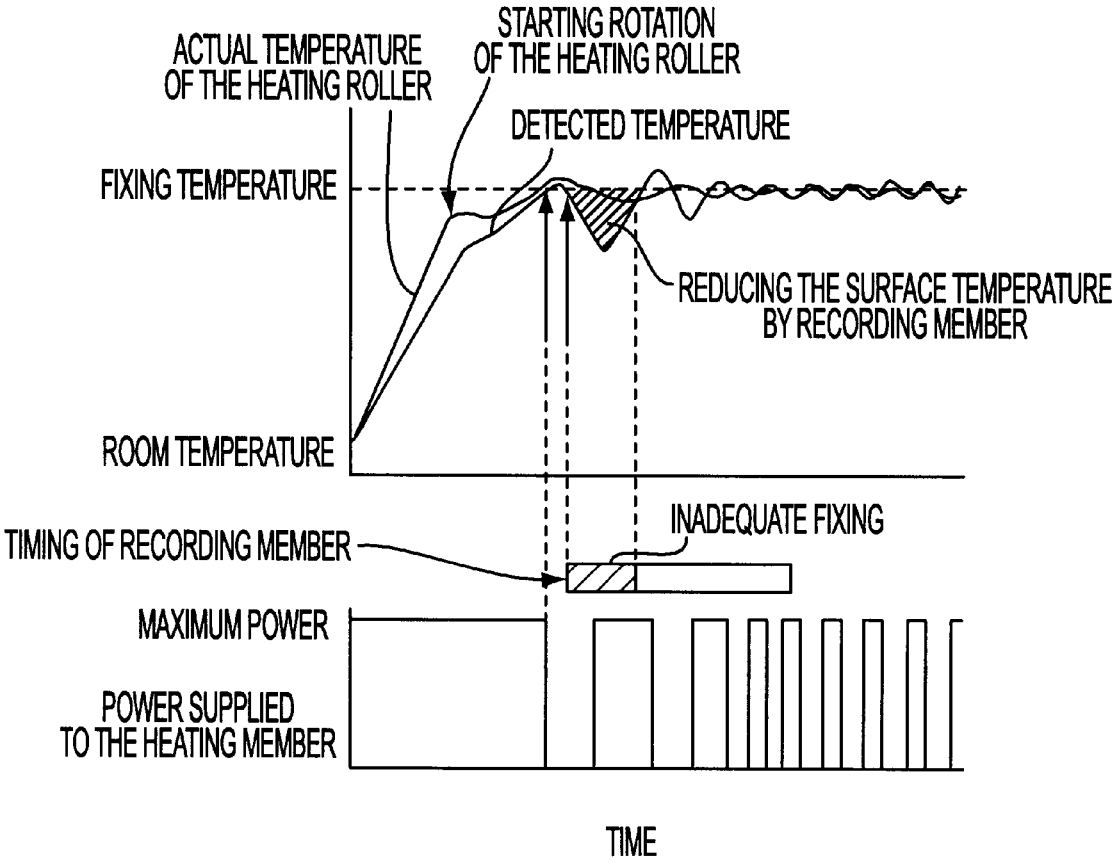
FIG. 6 shows, in a conventional fixing device, an example the surface temperature of a heating roller and the change in the temperature detected by a thermistor when the heating roller starts rotation during the warm-up period, and an example of the control of power supplied to a resistance heating element, and an example of the timing of passing a recording sheet between heating and pressure rollers (sheet transport timing)

In the case of conventional fixing devices, a fixing temperature cannot be maintained when a recording member is inserted because, as shown in FIG. 6, there is a delay in the power supplied to the resistance heating member due to the delayed response by the thermistor even when, for example, the heating roller is rotated during the warm-up period, thereby reducing the surface temperature of the heating roller so as to cause inadequate fixing.

The previously described fixing device fuses an unfixed toner image onto a recording device by passing a recording member bearing an unfixed toner image between a heating roller 1 and a pressure roller 4, and supplies a power level to the resistance heating element 13 that is required to maintain the temperature of the heating roller 1 at a predetermined fixing temperature directly after insertion of a recording member between said heating roller 1 and pressure roller 4 by starting rotation of the heating roller 1 and pressure roller 4 before the warm-up period ends and in accordance with the rate of temperature rise of the heating roller temperature during rotation of the heating roller after heating roller 1 starts rotation but before the warm-up period ends. Accordingly, fluctuation of the temperature of heating roller 1 is suppressed when a recording member is inserted between heating roller 1 and pressure roller 4 after a quick warm up, so as to obtain fixed images of excellent quality.

From the perspective of overall operation of the copier, image formation may be started without waiting for the warm-up period to end by starting rotation of elements connected to the heating roller 1 before warm-up ends and inserting a recording member between the heating roller and pressure roller because the present invention allows a recording member to be inserted when rotation of heating roller 1 and pressure roller 4 starts before the warm-up period ends, thereby achieving an effect identical to shortening of the warm-up time.

Figure 7:
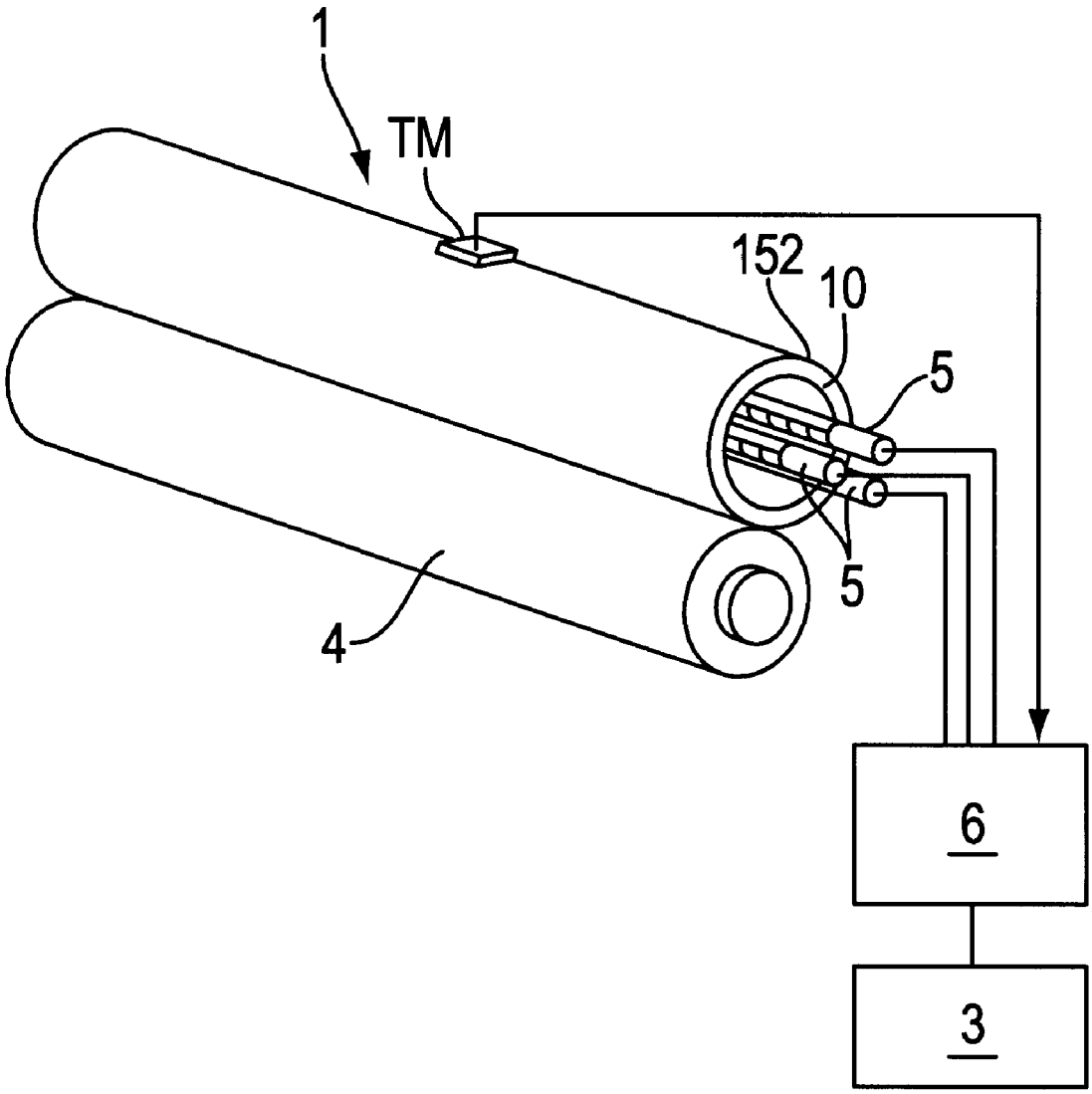
FIG. 7 is a brief perspective view of another example of the fixing device of the present invention.

The heating means of heating roller 1 may be a plurality of heat sources rather than the resistance heating element 13. Refer now to the example shown in FIG. 7. FIG. 7 is a brief perspective view showing the essential parts of another example of the fixing device of the present invention.

This fixing device is provided with a heating roller 1 and a pressure roller 4 that is pressed against said heating roller 1 via a pressing means not shown in the drawing.

The heating roller 1 comprises a cylindrical aluminum core roller 10 formed as a thin layer having a thickness to a degree which does not pose a problem respective to strength, and superimposed over the exterior surface of said core roller is a separation layer 152. A plurality (i.e., three in the present example) of lamp heaters 5 are built into the interior of core roller 10.

Each of the three lamp heaters 5 have a different power consumption, i.e., different heat release value. Each lamp heater 5 is connected to a heater drive circuit 6. Control unit 3, which controls said drive circuit 6, determines the rate of temperature rise of heating roller 1 in the same manner as previously described based on temperature information detected by a thermistor disposed in contact with said heating roller 1, and controls the level of power supplied to said lamp heaters 5 in accordance with the determined rate of temperature rise. At this time control unit 3 controls the amount of heat supplied to heating roller 1 by selectively supplying power to any one among said three lamp heaters 5, a combination of any two said lamp heaters 5, or all three said lamp heaters 5.

The heating means of heating roller 5 may be a heating means of a an electromagnetic conduction type capable of directly heating the heating roller body rather than the previously described resistance heating element 13 or lamp heaters 5.

Furthermore, the material used to construct the various elements of the fixing device of the present invention are not necessarily limited to the previously mentioned materials.

In addition to the previously described copying machine, the fixing device 100 may be used in printers and facsimile machines of the electrophotographic type.

The present invention provides a fixing device comprising a rotating heating member heated by a heating means; a rotating pressure member which presses against said rotating heating means; a temperature detecting means to detect the temperature of said rotating heating means; and a control means to control the electric power supplied to said heating means based on the temperature detected by said temperature detecting means, said fixing device being of a type which fixes an unfixed toner image on a recording member by having a recording member bearing an unfixed toner image pass between said rotating heating member and said rotating pressure member, and wherein the warm-up time of said rotating heating member can be shortened by using a thin-layer rotating heating member and a heating means capable of rapidly and directly heating said rotating heating means, and the fixed images of excellent quality can be obtained by controlling the temperature fluctuation of the rotating heating member wen a recording member is inserted between said rotating heating member and said rotating pressure member after the rotating heating member has been warmed up.

The control means of the present invention provides a fixing device capable of producing fixed images of excellent quality by controlling the power supplied to a heating means at a power required to maintain the rotating heating member temperature at a predetermined temperature directly after insertion of a recording member between said heating member and a rotating pressure member in accordance with the rate of temperature rise of said rotating heating member during rotation of said rotating heating member from the start of rotation or after the start of rotation of said rotating heating member but before a warm-up period ends.

The control means of the present invention provides a fixing device capable of producing fixed image of excellent quality by controlling the power supplied to a heating means at a power level required to maintain the rotating heating member temperature at a predetermined temperature directly after insertion of a recording member between said rotating heating member and a rotating pressure member in accordance with the temperature rise time from a first temperature detected by a temperature detecting means at the start of rotation or after the start of rotation of said rotating heating member until a second temperature detected during rotating of said rotating heating member after detection of said first temperature but before the warm-up period ends.

The control means of the present invention provides a fixing device capable of producing fixed images of excellent quality by controlling the power supplied to a heating means at a power level required to maintain the rotating heating member temperature at a predetermined temperature directly after insertion of a recording member between said rotating heating member and a rotating pressure member in accordance with the difference between a first temperature detected by a temperature detecting means at the start of rotation or after the start of rotation of said rotating heating member and a second temperature detected after the detection of said first temperature but before the warm-up period ends.

The present invention provides a fixing device comprising a rotating heating member heated by a heating means having two or more heat sources, a rotating pressure member pressed against said rotating heating member, temperature detecting means to detect the temperature of said rotating heating member, and control means to control the power supplied to said heating means based on the temperature detected by said temperature detecting means, wherein said rotating heating means starts rotation before the warm-up period ends, and wherein said control means selectively supplied power to specific heat sources among said two or more heat sources so as to supply the power required to maintain the rotating heating member temperature at a predetermined temperature directly after insertion of a recording member between said rotating heating member and said rotating pressure member in accordance with the rate of temperature rise of said rotating heating member during rotation of said rotating heating member from the start of rotation or after the start of rotation of said rotating heating member but before the warm-up period ends, so as to produce fixed images of excellent quality.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A heating device comprising:

a rotating member to be warmed-up by a warm-up operation and to start rotating before an end of the warm-up operation;

a temperature detector to detect a temperature of said rotating member; and a controller to control the temperature of said rotating member to maintain a predetermined temperature after the warm-up operation, in accordance with a rate of temperature rise of said rotating member occurring during said warm-up operation while said rotating member is rotating.

2. The heating device of claim 1, further comprising a pressure member pressed against said rotating member.

3. The heating device of claim 2, further comprising a heating element interposed between said rotating member and said pressure member.

4. The heating device of claim 1, further comprising a timer to measure a time period for the temperature of said rotating member to rise from a first temperature to a second temperature while rotating during the warm-up operation, wherein said controller controls the temperature of said rotating member to maintain a predetermined temperature after the warm-up operation, in accordance with the time period measured by said timer.

5. The heating device of claim 4, wherein said first temperature is detected by said temperature detector when said rotating member starts rotating, and said second temperature is detected by said temperature detector during rotation of said rotating member before the warm-up operation ends after the detection of said first temperature.

6. The heating device of claim 4, wherein said first temperature is detected by said temperature detector after the start of rotating by said rotating member, and said second temperature is detected by said temperature detector during rotation of said rotating member before the warm-up operation ends after the detection of said first temperature.

7. The heating device of claim 1, wherein said temperature detector detects the temperature of said rotating member while rotating at a first timing during the warm-up operation and further detects the temperature of said rotating member while rotating at a second timing, and said controller controls the temperature of said rotating member to maintain a predetermined temperature after the warm-up operation, in accordance with the difference between the temperatures detected at the first timing and the second timing.

8. The heating device of claim 7, wherein said first timing occurs at the start of rotating of the rotating member.

9. The heating device of claim 7, wherein a first temperature is detected by said temperature detector after starting of rotating of the rotating member.

10. The heating device of claim 1, further comprising a plurality of heat sources to heat said rotating member.

11. The heating device of claim 10, wherein said controller controls a number of heat sources which are powered.

12. The heating device of claim 11, wherein said powered heat sources have different power.

13. The heating device of claim 1, wherein said rotating member includes a resistance heating element heated by spurring current flow.

14. The heating device of claim 13, wherein said controller controls pulse width of said current flow of said resistance heating element.

15. The heating device of claim 13, wherein said controller controls phase of said current flow of said resistance heating element.

16. A heating device comprising:

a rotating member to be warmed-up by a warm-up operation and to start rotating before an end of the warm-up operation;

a temperature detector to detect a temperature of said rotating member;

a timer to measure a time period for the temperature of said rotating member to rise form a first temperature to a second temperature while rotating during the warm-up operation; and a controller to control the temperature of said rotating member to maintain a predetermined temperature after the warm-up operation, in accordance with a rate of temperature rise of the rotating member occurring during the time period measured by said timer.

17. The heating device of claim 16, wherein said first temperature is detected by said temperature detector when said rotating member starts rotating, and said second temperature is detected by said temperature detector during rotation of said rotating member before the warm-up operation ends and after the detection of said first temperature.

18. The heating device of claim 16, wherein said first temperature is detected by said temperature detector after starting of rotating by said rotating member, and said second temperature is detected by said temperature detector during rotation of said rotating member before the warm-up operation ends and after the detection of said first temperature.

19. A heating device comprising:

a rotating member to be warmed-up by a warm-up operation and to start rotating before an end of the warm-up operation;

a temperature detector to detect a temperature of said rotating member at a first timing while said rotating member is rotating during the warm-up operation and to detect the temperature of said rotating member at a second timing while said rotating member is rotating during the warm-up operation; and a controller to control the temperature of said rotating member to maintain a predetermined temperature after the warm-up operation, in accordance with a rate of temperature rise of said rotating member from the temperature detected at the first timing to the temperature detected at the second timing.

20. The heating device of claim 19, wherein said first timing is at the start of rotating of said rotating member.

21. The heating device of claim 19, wherein a first temperature is detected by said temperature detector during rotating of said rotating member.

22. A heating method comprising the steps of:

warming-up a rotating member;

rotating said rotating member before an end of said warming-up step;

while rotating said rotating member during said warming-up step, detecting a first temperature of said rotating member at a first timing and a second temperature of said rotating member at a second timing; and controlling the temperature of said rotating member to maintain a predetermined temperature after the warming-up step, in accordance with the rate of temperature rise of said rotating member from said first temperature at said first timing to said second temperature at said second timing during said warming-up step.

23. A heating method comprising the steps of:

warming-up a rotating member;

rotating said rotating member before an end of said warming-up step;

detecting a temperature of said rotating member while rotating said rotating member during said warming-up step; and controlling the temperature of said rotating member to maintain a predetermined temperature after the warming-up step, in accordance with a rate of temperature rise of said rotating member occurring during said warming-up step.

* * * * *